US005791779A

United States Patent [19]

Smith, Sr.

[11] Patent Number: 5,791,779

[45] Date of Patent: Aug. 11, 1998

[54] MIXING ASSEMBLY FOR CONTINUOUS MIXER

[75] Inventor: Robert J. Smith, Sr., Spring Lake, Mich.

[73] Assignee: Sandmold Systems, Inc., Newaygo, Mich.

[21] Appl. No.: 677,405

[22] Filed: Jul. 9, 1996

[51] Int. Cl.[6] ..... B01F 7/02

[52] U.S. Cl. ..... 366/297; 366/325.1; 366/315; 366/330.1

[58] Field of Search ..... 366/295, 296, 366/297, 299, 300, 301, 315, 322, 321, 330.1, 330.2, 325.92, 325.1

[56] References Cited

U.S. PATENT DOCUMENTS

| | | | |
|---|---|---|---|
| 37,214 | 12/1862 | Brinkerhoff . | |
| 120,849 | 11/1871 | Broyhill et al. . | |
| D. 309,904 | 8/1990 | Morrison . | |
| 376,552 | 1/1888 | Rossler . | |
| 470,097 | 3/1892 | Baldwin . | |
| 523,646 | 7/1894 | Schaefer . | |
| 950,990 | 3/1910 | Boyd . | |
| 980,834 | 1/1911 | Raber et al. . | |
| 1,017,820 | 2/1912 | Svebilius . | |
| 2,111,178 | 3/1938 | Crumback . | |
| 2,365,897 | 12/1944 | Morgan . | |
| 2,600,408 | 6/1952 | Komarek . | |
| 2,806,298 | 9/1957 | Rossi . | |
| 2,900,177 | 8/1959 | Fye . | |
| 3,224,929 | 12/1965 | Fair . | |
| 3,332,368 | 7/1967 | Stickelber . | |
| 3,622,126 | 11/1971 | Eberle et al. . | |
| 3,730,487 | 5/1973 | Lund . | |
| 3,901,482 | 8/1975 | Kieffaber | 366/301 |
| 4,036,477 | 7/1977 | Sieradzki et al. | 366/300 |
| 4,281,934 | 8/1981 | Krause et al. . | |
| 4,474,479 | 10/1984 | Redelman . | |
| 4,483,625 | 11/1984 | Fisher | 366/297 |
| 4,560,281 | 12/1985 | Harris et al. | 366/299 |
| 4,761,897 | 8/1988 | Tazaki et al. . | |
| 4,775,239 | 10/1988 | Martinek et al. | 366/300 |
| 4,848,919 | 7/1989 | Lipp et al. . | |
| 5,151,739 | 9/1992 | Hediger . | |
| 5,220,382 | 6/1993 | Hediger | 366/325.92 |
| 5,298,952 | 3/1994 | Kamijo et al. . | |
| 5,419,635 | 5/1995 | Schulte et al. | 366/299 |

FOREIGN PATENT DOCUMENTS

| | | | |
|---|---|---|---|
| 29394 | 1/1884 | Germany | 366/300 |
| 1059944 | 10/1952 | Germany | 366/301 |
| 851073 | 10/1952 | Germany | 366/297 |
| 863470 | 1/1953 | Germany | 366/397 |
| 465764 | 9/1951 | Italy | 416/200 |

*Primary Examiner*—Tony G. Soohoo

*Attorney, Agent, or Firm*—Price, Heneveld, Cooper, DeWitt & Litton

[57] ABSTRACT

A continuous mixer has an elongated trough with two mixer assemblies mounted therein in a mutually parallel, laterally spaced apart relationship for axial rotation in opposite directions. Each mixer assembly has a rigid shaft with a plurality of blades mounted thereon which are shaped and mutually arranged to achieve an intersecting helical effect in the trough. The blades are arranged in sets of at least two, axially adjacent ones of said blades, wherein the blades within each set has a substantially identical circumferential position on its shaft, and the sets are positioned in a circumferentially staggered pattern about the shaft to axially balance the mixing assemblies, and thereby alleviate vibration, even during high speed mixing. Counterbalance weights or eccentric blades on the shafts can also be used to improve the dynamic balance of the mixing assemblies.

26 Claims, 2 Drawing Sheets

MIXING ASSEMBLY FOR CONTINUOUS MIXER

BACKGROUND OF THE INVENTION

The present invention relates to mixing apparatuses in general, and in particular to an improved mixer assembly for continuous flow, dual shaft, auger-type mixers.

Continuous flow mixers for foodstuffs, detergents, herbicides, etc. are well known in the art. Such mixers are also used in connection with the conditioning of foundry sand, where it is desirable to intermix a liquid binder and a liquid catalyst with a mass of dry sand, as well as for a variety of other industrial uses such as the mixing of granular materials or various plastic or other semi-solid materials. Irrespective of the particular use to which such mixers are put, their essential features are generally similar.

More specifically, continuous flow mixers typically employ an elongated mixing trough having two mixer assemblies mounted therein, having rotatable, blade-carrying shafts which operate in various ways to effect intermixing of different materials in the trough, while at the same time impelling the mixture or mixed mass longitudinally to a region of discharge from the trough. The principals of operation ascribed to such mixers vary widely, many of them relying mainly upon a high degree of turbulence within the mixing trough in order to effect an indiscriminate mixing action. These mixing apparatuses employ a variety of combinations of blade configuration, blade orientation, blade interaction, and shaft spacial relationships to accomplish the desired intermixing action of the materials introduced to the trough area.

One such mixer, as disclosed in U.S. Pat. No. 3,730,487 to Lund, includes two cooperating rotatable, parallel companion shafts have rows of specially shaped fixed blades thereon, which operate within the mixing trough, utilizing a slicing or cutting and camming action to split and pass masses of the materials to be intermixed alternately back and forth from shaft to shaft. As the mass of materials proceeds from blade to blade, the material mass is severed into two portions to be mixed with another portion and again severed into portions at a subsequent blade. This results in a thoroughly integrated material mass upon reaching the discharge region of the trough.

The mixer assemblies utilized in such mixers generally comprise a central blade-supporting shaft on which is mounted a longitudinal series of blades. Each blade is suitably affixed to the shaft and is in the form of a flat disk having an interrupted-elliptical contour. Each blade is affixed relative to the longitudinal axis of the shaft so that the plane thereof intersects the shaft axis at a relatively sharp angle, which is generally on the order of 45 degrees. The blades on one shaft assembly have a right-hand pitch angle, and the blades on the other shaft assembly have a left-hand pitch angle. The blades on each respective shaft are mounted on the same side of the shaft in longitudinal alignment, as shown in FIG. 8. The shaft assemblies are positioned with respect to each other such that the blades of both shaft extend in an identical lateral direction. During operation, the shafts are rotated in opposite directions (i.e., one shaft rotating clockwise and the other shaft rotating counterclockwise). The counter-rotation of the shafts with the blades in this position facilitates alternating interaction of laterally adjacent blades on the material mass to be mixed, and the angled relationship of the blade to the shaft induces a longitudinal progression of the material mass from the trough inlet region to the trough discharge region.

While this unique configuration of interacting blades results in a very uniform homogeneous mixture being discharged from the apparatus, the positioning of the blades of one shaft in longitudinal alignment on one side of the shaft creates an imbalanced shaft assembly. Although the imbalance of the shaft assembly has no appreciable negative effect at relatively low shaft rotational speeds, a significant vibration problem exists when attempting to operate the mixing apparatus at high shaft rotational speeds. High-speed operation of the mixing apparatus is desirable in many mixing operations and promotes efficient utilization of capital resources. However, operating such a mixing apparatus at high rotational speeds in such an imbalanced condition results in the rapid wearing and short lifetime of apparatus components such as bearings, shafts, and motors. Thus, it is desirable to have a mixing apparatus which operates substantially vibration free thereby improving the operating efficiency of the apparatus and extending the operating lifetime of the mixing apparatus components.

SUMMARY OF THE INVENTION

One aspect of the present invention is an improved mixing apparatus of the type having an elongated trough with two mixer assemblies mounted therein in a mutually parallel, laterally spaced apart relationship for axial rotation in opposite directions. Each of the mixer assemblies has a rigid shaft with a plurality of blades mounted thereon which are shaped and mutually arranged to achieve an intersecting helical effect in the trough. The blades on each of the mixing assemblies are arranged in sets of at least two, axially adjacent blades, wherein the blades within each set has a substantially identical circumferential position on the associated shaft. The sets are positioned in a circumferentially staggered pattern about the associated shaft to axially balance the mixing assemblies, and thereby alleviate vibration even during high speed mixing.

Another aspect of the instant invention is an improved mixing apparatus of the type having an elongated mixing trough having a receiving end and a discharge end, a pair of parallel companion mixer assemblies rotatable in the trough, wherein each mixer assembly is comprised of a shaft in a plurality of axially spaced sloping parallel interrupted-elliptical disk-like mixing blades on the shaft. The blades on the two mixer assemblies have equal but reverse pitch angles and are disposed in transverse pairs, and in one position of the mixer assemblies the blades project predominately laterally in the same direction. The maximum radial projection of the blades from the shaft is slightly less than the distance between the shafts, and the mixer assemblies rotate in unison in different directions. A plurality of the blades are longitudinally displaced along the shaft and angularly disposed around the shaft, such that each blade acts in whole or in combination with the other blades to counterbalance the other blade to effect substantially vibration-free rotation of the mixer assemblies.

Yet another aspect of the present invention is to provide an improved mixing apparatus of the type having an elongated mixing trough having a receiving end and discharge end and a pair of parallel companion mixer assemblies rotatable in the trough wherein each mixer assembly is comprised of a shaft and a plurality of axially spaced sloping parallel interrupted-elliptical disk-like mixing blades on the shaft. The blades on the two mixer assemblies have equal but reverse pitch angles and are disposed in transverse pairs wherein the blades in one position of the mixer assemblies project predominantly laterally in the same direction. The maximum radial projection of the blades from the shaft is slightly less than the distance between the shafts and the mixer assemblies rotate in unison and in different directions. A sleeve assembly, comprising a sleeve having a longitudinal aperture therethrough, has a plurality of blades affixed to an exterior surface of the sleeve. The longitudinal aperture of the sleeve has a central longitudinal axis which is parallel to and radially disposed from a geometric central axis of the sleeve, thereby forming a counterbalance lobe substantially radially opposite the aperture central axis for balancing the sleeve assembly during rotation. The blades are affixed to the exterior of the sleeve and are positioned substantially opposite the counterbalance lobe.

The principal object of the present invention is to provide a rotationally balanced mixer assembly in a continuous mixer, while retaining the unique mixing characteristics and properties of the interrupted elliptical disk-like blades. The balanced mixer assemblies permit high speed mixing applications. This provides extraordinary mixing action permitting complete dispersion as the material is divided, lifted and transferred back and forth between the counter rotating shaft assemblies. The mixing action is such that it will mix even fragile materials, such as cereals, detergents, etc., attaining complete homogeneity with little or no degradation of the material. The mixer can thoroughly blend materials of various densities, and handle a wide range of consistencies.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
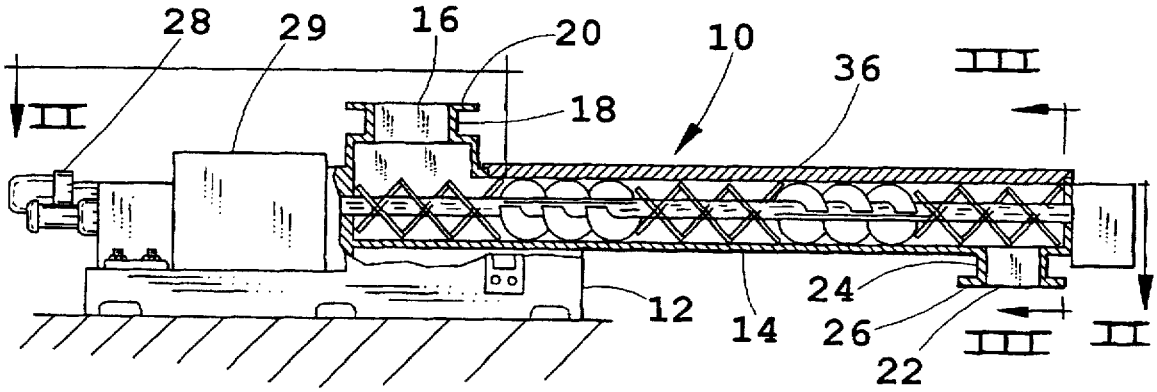
FIG. 1 is a side elevational view, partially in section, of a continuous mixer incorporating mixer assemblies according to the present invention.
Figure 2:
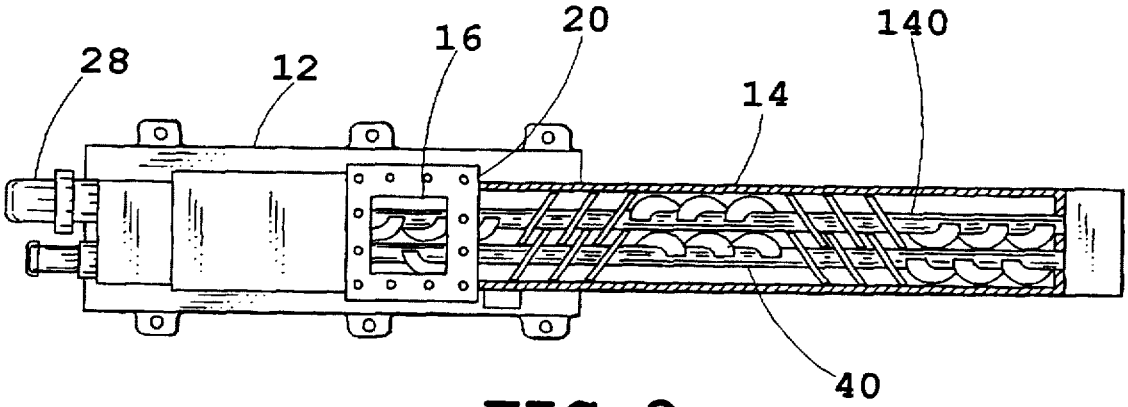
FIG. 2 is a top plan view, partially in section, of the mixer taken on the line II—II of FIG. 1.
Figure 4:
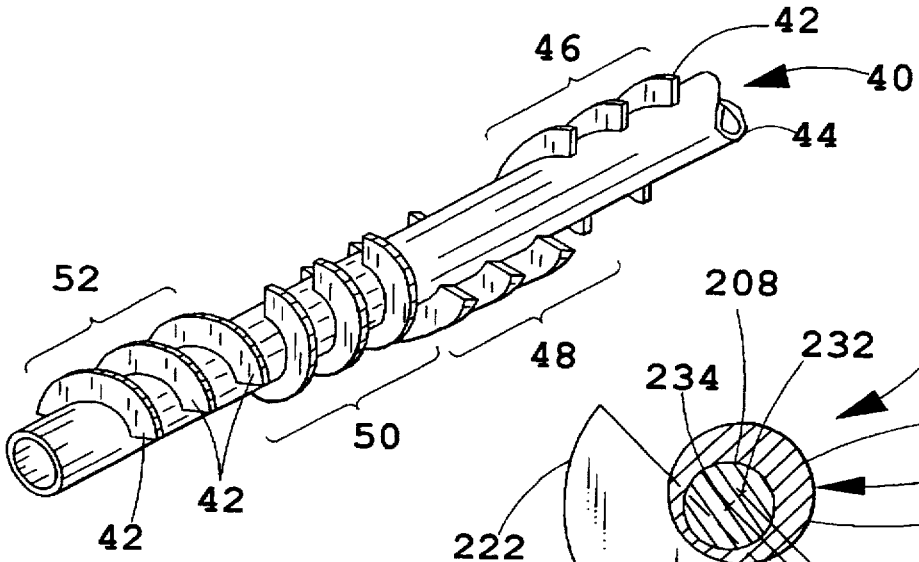
FIG. 4 is a perspective view of one of the mixer assemblies.

For purposes of description herein, the terms "upper," "lower," "right," "left," "rear," "front," "vertical," "horizontal," and derivatives thereof shall relate to the invention as oriented in FIGS. 1 and 4. However, it is to be understood that the invention may assume various alternative orientations and step sequences, except where expressly specified to the contrary. It is also to be understood that the specific devices and processes illustrated in the attached drawings and described the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1–4 show a mixing apparatus 10, incorporating one of the preferred embodiments of the present invention, and illustrates its various components. Mixing apparatus 10 involves in its general organization an elongated, upwardly opening, mixing trough 14 which is adapted to receive the materials to be mixed therein. The mixing function is accomplished by two spaced apart, parallel, cooperating, material mixing and impelling mixer assemblies 40 and 140 which extend horizontally in trough 14, rotate in opposite directions, and are provided with mixer blades. The mixer blades cooperate with one another to effect a repeated sub-division of the mass of materials within mixing trough 14 while at the same time causing the sub-divided masses to flow longitudinally along trough 14 to a region of discharge.

The mixing apparatus 10 comprises base 12 adapted for mounting to a floor, building structure, or other rigid support. An inlet end of trough 14 is typically supported in cantilevered fashion by base 12. Also mounted on base 12 is electric motor 28 which transmits rotational power through controlling mechanism 29 to impart rotation of mixer assemblies 40 and 140. While the function of controlling mechanism 29 is necessary to the overall operation of mixing apparatus 10, mechanism 29 does not bear upon the inventive concepts of the preferred embodiment, the details of which are therefore not described herein. Positioned at one end of trough 14 is inlet 18 having an inlet opening 16 through which material to be mixed is introduced to trough 14. Flange 20 is circumscribed about inlet opening 16 to facilitate the attachment of ducting (not shown) for the continuous delivery of materials to be mixed to mixing apparatus 10. At an opposite cantilevered forward end region of trough 14 and positioned at trough bottom 38, discharge 24 is provided having a downwardly facing discharge opening 22 for the materials undergoing mixing in trough 14. Again, as with inlet 18, flange 26 is circumscribed about discharge opening 22 for attachment of ducting for the channeling of mixed material away from mixing apparatus 10.

Figure 3:
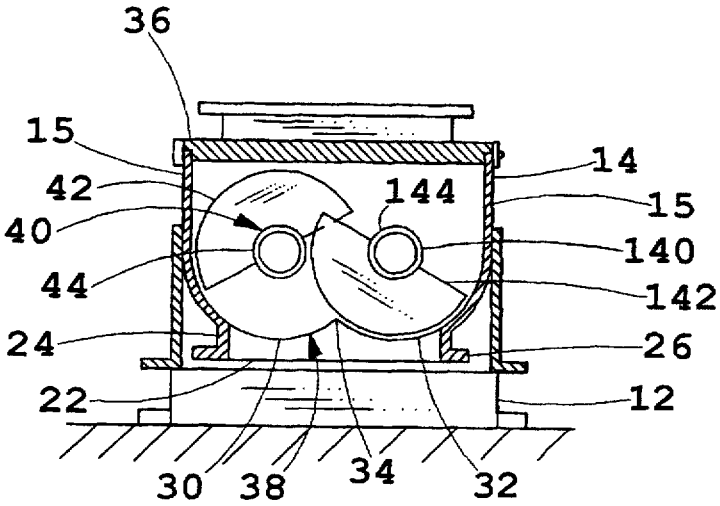
FIG. 3 is an enlarged vertical sectional view of the mixer, taken on the line III—III of FIG. 1, showing the relationship of the adjacent mixer assemblies.

As best shown in FIG. 3 of the drawings, mixing trough 14 may be formed of relatively heavy gauge sheet metal, and is provided with two spaced apart and upstanding trough sides 15 and a divided two-channel trough bottom 38. Trough bottom 38 defines two shallow semi-cylindrical trough channels 30 and 32 which are separated by a longitudinally extending saddle 34 of relatively small height. A cover 36 is removably attached to a top portion of trough 14 and extends between trough sides 15. Cover 36 prevents the flinging or discharge of materials out of the top portion of trough 14 as would normally occur during high speed operation of mixing apparatus 10.

Mixer assemblies 40 and 140 are disposed in and operate within the confines of mixing trough 14. The aforementioned mixer assemblies 40 and 140 are of similar construction and, therefore, a description of one will suffice largely for both assemblies. First considering mixer assembly 40, mixer assembly 40 includes a central blade supporting rigid shaft 44 on which is mounted a series of blades 42. (See FIGS. 1–4) Each blade is in the form of a flat disk having an interrupted-elliptical contour, blade 42 being affixed to shaft 44 so that the plane thereof intersects the longitudinal axis of the shaft at a relatively sharp angle which may be on the order of 45 degrees. As illustrated in FIG. 4, blades 42 are divided into sets comprising an equal number of blades such as sets 46, 48, 50, and 52. The blades of each blade set, as for example blade set 52, are axially adjacent and longitudinally aligned on shaft 44 such that each blade 42 is parallel to an axially adjacent blade 42 in blade set 52, and the blades have a substantially identical circumferential position on the shaft and are equally spaced therebetween. The blade sets are positioned in a circumferentially staggered pattern about shaft 44 and each adjacent blade set such as blade set 50 is substantially equi-angularly disposed about shaft 44 with respect to the previous blade set, such as blade set 52. The blades of blade set 50 are positioned at a like pitch angle relative to the longitudinal axis of shaft 44. In the preferred embodiment, mixer assembly 40 comprises four blades sets 46–52 with each set angularly displaced 90 degrees from a previous blade set and progressing about shaft 44 in a helical fashion. In mixer assembly 40, as shown, blade sets 46 and 50 are displaced about shaft 44 at a relative angle of 180 degrees with respect to each other and thus counterbalance each other, and blade sets 48 and 52 likewise counterbalance each other, thus providing mixer assembly 40 with a rotationally balanced configuration. It will be understood by those skilled in the art that any number of blade sets of an equal number of blades may be utilized to populate mixer assembly 40 provided that the blade sets are angularly positioned about shaft 44 in a manner such that there is an equal distribution of blades about the periphery of shaft 44.

Mixer assembly 140 is similar to mixer assembly 40 in that mixer assembly 140 is comprised of an equal number of blade sets as mixer assembly 40 with an equal number of blades 142 attached to rigid shaft 144 in each set. However, blades 142 are mounted on shaft 144 with an equal but opposite pitch angle with respect to shaft 144 as blades 42 have in relationship to mixer 44 of shaft assembly 40. Additionally, the blade sets of mixer assembly 140 progress about the periphery of shaft 144 in an equal but opposite helical fashion as do blade sets 46–52 on mixer assembly 40 therefore achieving an intersecting helical effect in trough 14.

Mixer assemblies 40 and 140 are positioned in trough 14 in a lateral side-by-side relationship such that each progressive blade of mixer assembly 40 is in a laterally transverse relationship to a corresponding blade of mixer assembly 140. Further, each laterally transverse set of blades of the two adjacent mixer assemblies are rotationally positioned such that when the blades 42 of one transverse set of blades horizontally projects away from the axis of shaft 44 the blades of the corresponding blade set on shaft 144 project in the same horizontal direction.

The equal angular disposition of blade sets about their respective shafts presents an equal distribution of weight about the shaft longitudinal axis. Each of the blades 42 or 142 acts in whole, or in combination with other blades, to counterbalance other blades on the respective shaft assemblies during rotational operation. Therefore, during operation and rotation of the respective mixer assemblies 40 and 140 at high speeds, the mixer assemblies are essentially rotationally balanced thereby presenting an operational configuration producing minimal vibration.

The mixer assembly of the preferred embodiment has the advantage of equal blade distribution about the shaft for balanced operation and the advantageous mixing characteristic of longitudinally aligned blades alternately acting with oppositely pitched like aligned blades on an adjacent mixer assembly as in the prior art.

Figure 5:
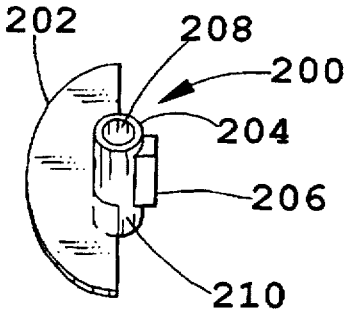
FIG. 5 is a front elevational view of another embodiment of the invention, having a sleeve assembly incorporating a counterbalance weight.

In an alternate configuration, mixer assembly 40, and in opposite manner mixer assembly 140, is comprised of shaft 44 and a longitudinal series sleeve assemblies such as sleeve assembly 200 shown in FIG. 5. Sleeve assembly 200 is comprised of sleeve 204 having a longitudinal aperture 208 running therethrough. Aperture 208 is sized marginally larger than shaft 44 to sleeve over shaft 44. Affixed to exterior surface 210 of sleeve 204 is blade 202 oriented at a desired pitch angle (such as 45 degrees) and counterbalance weight 206 positioned substantially opposite blade 202. The various sleeve assemblies 200 are sleeved over or telescopically received on shafts 44 and 144 in end-to-end abutting relationship and in such a manner that all of blades 202 are longitudinally aligned on shaft 44 with the blades on mixer assembly 40 presenting an equal but opposite pitch angle to the blades on mixer assembly 140. Suitable means are provided for securely anchoring sleeve unit 200 to shaft 44 or 144 such as by either keying sleeve assemblies 200 to the shaft or by securing to the shaft with set screws. Since each sleeve assembly 200 has a counterbalance weight 206 offsetting the rotational imbalance induced by blade 202, mixer assemblies may be configured with all blades in a longitudinally aligned fashion or they may be configured in blade sets angularly disposed about the central shaft in an equal but opposite helical fashion as described above for mixer assemblies 40 and 140.

Figure 6:
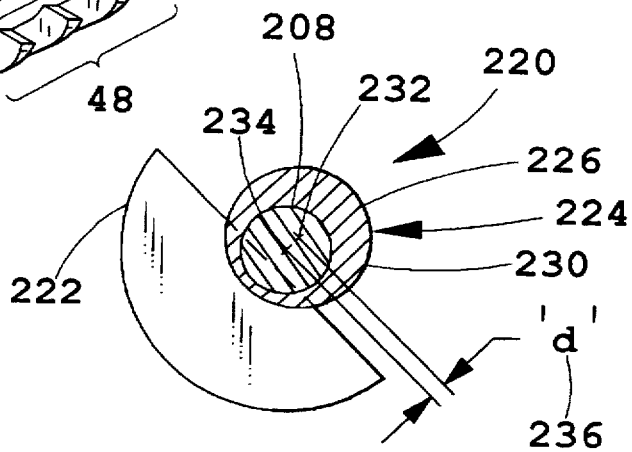
FIG. 6 is an end view of yet another embodiment of the invention, having a lobed sleeve assembly showing the sleeve aperture offset from the geometrical center of the sleeve forming a weighted lobe for rotationally balancing the sleeve assembly.

Sleeve assembly 220 shown in FIG. 6 presents an alternate configuration of sleeve assembly 200. In this embodiment sleeve 224 has attached to exterior surface 230 a blade 222 in a like fashion as blade 202 is attached to sleeve 204 of sleeve assembly 200. However, longitudinal aperture 208 of sleeve 224 has geometric center 234 which is offset by dimension 'd' from the geometric center 232 of sleeve 224. The offset aperture 208 forms lobe 226 on one side of sleeve 224. The dimension 'd' of offset 236 is selected such that the weight of lobe 226 offsets the rotational imbalance induced by blade 222 by mounting blade 222 on sleeve 224 substantially opposite lobe 226. The diameter of aperture 208 is selected to be marginally larger than shaft 44 so that sleeve assembly 220 may be telescopically received on shaft 44 or 144. Again, in like manner as sleeves 200, sleeves 220 may be configured on their respective mixer assemblies such that blades 222 are either in a longitudinally aligned relationship, or such that blade assemblies 220 are configured in sets of equal numbers wherein the sets are arranged on shafts 44 and 144 in an equal but opposite helical fashion.

Figure 8:
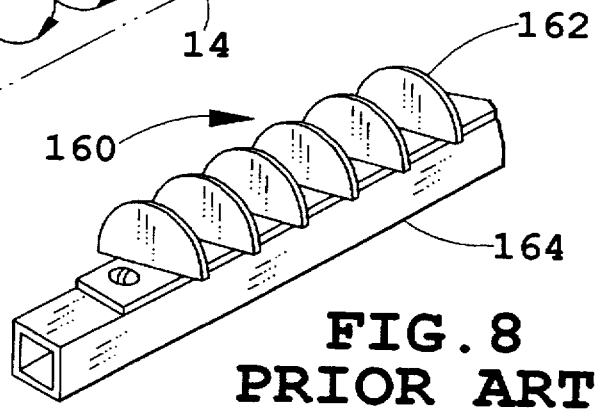
FIG. 8 PRIOR ART
FIG. 8 shows a shaft assembly of the prior art wherein the blades are longitudinally aligned on one side of the shaft thereby placing the shaft in an imbalanced condition.

FIG. 8 discloses a mixer assembly 160 comprising shaft 164 which may be either square or circular in cross section to which are affixed blades 162. Blades 162 are mounted in parallel fashion and are longitudinally aligned upon shaft 164. Shaft assembly 160 represents a shaft assembly such as found in the prior art and can be adapted for rotationally balanced operation by affixing one or more counterbalance weights, such as counterbalance weight 206 in FIG. 5, to a surface of shaft 164 substantially opposite from blades 162 thereby counteracting the rotational imbalance induced when blades 162 are mounted substantially on one side of shaft 164. Alternatively, shaft assembly 160 can be adapted to rotate about an axis other than the geometrically central longitudinal axis of 164. By rotating shaft assembly 160 about a displaced axis which is offset by a dimension such as dimension 'd' 236 in FIG. 6, a counterbalance lobe can effectively be created to offset the rotational imbalance induced by blades 162.

In operation of the above-described mixing apparatus 10, materials to be mixed are introduced into trough 14 through inlet 18. Electric motor 28 provides rotational power to shafts 44 and 144 which are rotationally positioned in a manner such that mixer assemblies 40 and 140 rotate in opposite directions at equal speeds with no appreciable intermeshing of laterally transverse blades. The mixing action of mixer assemblies 40 and 140 functions largely upon the design of the mixing blades and the alternate engagement of those blades on the material mass to be mixed. The efficient mixing of materials is a function of the reverse slope of the two transverse series of blades and the fact that the mixer assemblies rotate in opposite directions in timed relationship thereby maintaining relative positions of each transverse pair of blades on each shaft during each complete rotation of adjacent mixer assemblies 40 and 140. During simultaneous rotation of mixer assemblies 40 and 140 throughout one complete revolution, there is no appreciable or effective intermeshing of blades 42 and 142 on either shaft with the laterally transverse blade on the other shaft. This absence of blade intermeshing or overlap serves to effect advantageous mixing functions for the efficient mixing of the desired materials.

Figure 7:
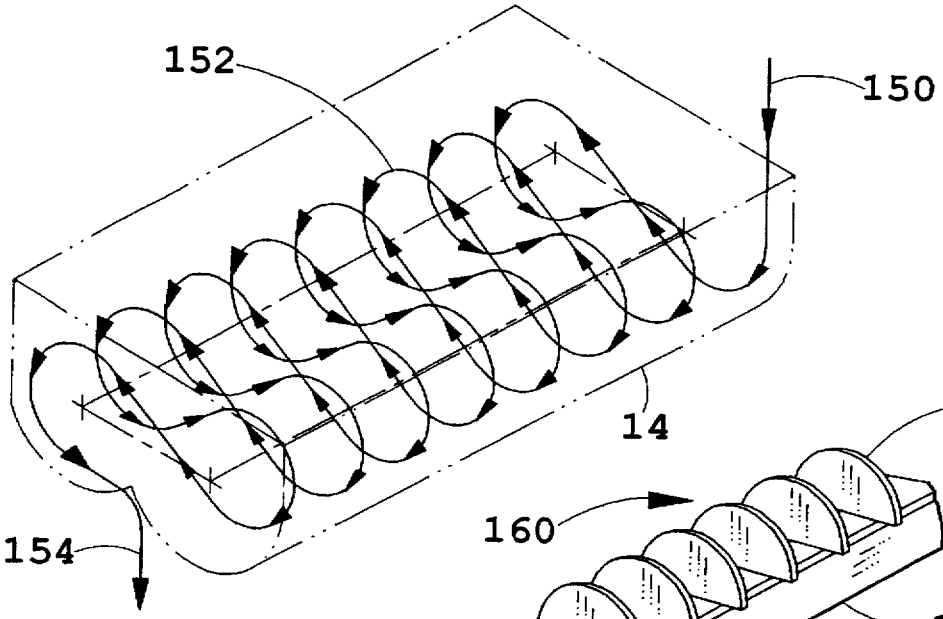
FIG. 7 is a diagrammatic view, schematic in its representation, illustrating the theoretical flow of material to be mixed as it longitudinally and laterally progresses from trough inlet alternating between shaft assemblies to the trough discharge.

As mixer assemblies 40 and 140 continue to rotate in opposite directions, the materials within trough 14 are laterally interchanged between mixer assemblies 40 and 140 while longitudinally progressing from inlet 18 to discharge 24. FIG. 7 illustrates in diagrammatical fashion the introduction 150 of materials to be mixed into trough 14, the alternating lateral transfer 152 between mixer assemblies and the longitudinal progression of materials along trough 14 until the discharge 154 of mixed materials from trough 14.

In the foregoing description, it will be readily appreciated by those skilled in the art that modifications may be made to the invention without departing from the concepts disclosed herein. Such modifications are to be considered as included in the following claims, unless these claims expressly state otherwise.

The embodiments of the invention in which an exclusive property or privilege is claimed are defined as follows:

1. A continuous mixer having an elongated trough with two mixer assemblies mounted therein in a mutually parallel, laterally spaced apart relationship for axial rotation in opposite directions; each of said mixer assemblies having a rigid shaft, and a plurality of blades on said rigid shaft, mounted thereon wherein said blades are shaped and mutually arranged along each said rigid shaft to achieve an intersecting helical mixing effect between said mixer assemblies in said trough; said blades on each of said mixing assemblies being arranged in axially adjacent sets of at least two, axially adjacent ones of said blades, wherein said blades within each of said sets have a substantially identical circumferential position on said associated shaft, and said sets are positioned in a circumferentially staggered pattern about said associated shaft to axially balance said mixing assemblies, and thereby alleviate vibration even during high speed mixing.

2. A mixer as set forth in claim 1, wherein:

said sets of blades have a mutual angular orientation between axially adjacent sets which is less than 180 degrees.

3. A mixer as set forth in claim 2, wherein:

said mutually angular orientation between axially adjacent sets of said blades is 90 degrees.

4. A mixer as set forth in claim 3, wherein:

each of said sets has at least three blades.

5. A mixer as set forth in claim 4, wherein:

each of said mixer assemblies has at least four of said sets of said blades.

6. A mixer as set forth in claim 5, wherein:

each of said blades has a helical shape.

7. A mixer as set forth in claim 5, wherein:

each of said blades has a flat semi-elliptical shape.

8. A mixer as set forth in claim 1, wherein:

each of said blades has a helical shape.

9. A mixer as set forth in claim 1, wherein:

each of said blades has a flat semi-elliptical shape.

10. A mixer as set forth in claim 1, wherein:

each of said mixer assemblies has four said sets of said blades.

11. A mixer, comprising an elongated mixing trough having a receiving end and a discharge end, a pair of parallel companion mixer assemblies rotatable in the trough, each mixer assembly including a shaft and a plurality of axially spaced sloping parallel interrupted-elliptical disk-like mixing blades mounted on said shaft, said blades on a first of said two mixer assemblies having equal but reverse pitch angles of said blades on a second of said two mixer assemblies, and said reversely pitched angled blades being disposed in transverse laterally adjacent pairs; said transverse laterally adjacent pairs of blades of said mixer assemblies projecting predominately laterally in a same direction when one of said laterally adjacent pairs projects from one of said shafts in said lateral direction, the maximum radial projection of said blades from said shaft being slightly less than the distance between said shafts, and each said assembly rotating axially about a longitudinal axis in unison with other adjacent ones of said assemblies and in different directions; said blades on each of said mixer assemblies being longitudinally displaced therealong and angularly disposed therearound, each said blade positioned about one of said shafts in whole or in combination with other said blades on said one of said shafts to counterbalance a second blade on said one of said shafts to effect substantially vibration-free rotation of each of said mixer assemblies thereby.

12. A mixer as set forth in claim 11, wherein:

said blades on each of said mixer assemblies comprises sets of blades, each of said sets comprising an equal number of said blades in longitudinal alignment, said sets of blades being angularly disposed substantially equally about said shaft.

13. A mixer as set forth in claim 12, wherein:

each of said mixer assemblies comprises four sets of blades, said sets being angularly disposed about each said shaft in helical fashion, each of said sets of said blades being angularly disposed substantially ninety degrees from an axially adjacent one of said sets of said blades, and further wherein said sets of blades on laterally adjacent mixer assemblies define adjacent oppositely progressing helixes.

14. A mixer as set forth in claim 11, wherein:

each said mixer assembly comprises at least one sleeve assembly, thereto to rotate in unison with said shaft, said sleeve assembly comprising a sleeve having a sleeve wall, said sleeve wall defining a longitudinal aperture extending through said sleeve and wherein said blades are affixed to an exterior surface of said sleeve, said sleeve assembly sleeved over said shaft and affixed thereto.

15. A mixer as set forth in claim 14, wherein:

said at least one sleeve assembly comprises a plurality of sleeve subassemblies sleeved over said shaft, each of said sleeve subassemblies comprising a sleeve and a plurality of blades in longitudinal alignment affixed to said exterior surface, said plurality of sleeve subassemblies being angularly disposed substantially equally about said shaft.

16. A mixer as set forth in claim 15, wherein:

said at least one sleeve assembly comprises four sleeve subassemblies sleeved over said shaft, said sleeve subassemblies being disposed about adjacent shafts in equal, opposite helical fashion, each of said sleeve subassemblies being angularly disposed substantially ninety degrees from the axially adjacent one of said sleeve subassemblies.

17. A mixer as set forth in claim 14, wherein:

said at least one sleeve assembly comprises a plurality of sleeve subassemblies sleeved over said shaft, each said sleeve subassembly comprising one sleeve having a sleeve wall, said sleeve wall defining a longitudinal aperture extending through said sleeve, and one blade affixed to an exterior surface of said sleeve, said sleeve subassemblies being angularly disposed substantially equally about the shaft.

18. A mixer as set forth in claim 17, wherein:

said sleeve subassemblies are arranged in sets, each said set comprising an equal number of sleeve subassemblies, said blades of each said set being longitudinally aligned, said sets of sleeve subassemblies being angularly disposed substantially equally about said shaft.

19. A mixer as set forth in claim 18, wherein:

each said mixer assembly comprises four sets of sleeve subassemblies, said sets being disposed about said adjacent shafts in equal, opposite helical fashion, each of said sets of sleeve subassemblies being angularly disposed substantially ninety degrees from an axially adjacent one of said sets of sleeve subassemblies.

20. A mixer, comprising an elongated mixing trough having a receiving end and a discharge end, a pair of parallel companion mixer assemblies rotatable in the trough, each mixer assembly comprised of a shaft and a plurality of axially spaced sloping parallel interrupted-elliptical disk-like mixing blades on said shaft, said blades on a first of said mixer assemblies having equal but reverse pitch angles of said blades on a second of laterally adjacent said mixer assemblies and reverse pitch angled blades being disposed in transverse pairs, said transverse laterally adjacent pairs of blades of said mixer assemblies projecting predominately laterally in a same direction when one of said laterally adjacent pairs projects from one of said shafts in said lateral direction, the maximum radial projection of said blades from said shaft being slightly less than the distance between said shafts, and said mixer assemblies rotating in unison and in different directions; each of said mixer assemblies further comprising a sleeve assembly having a sleeve with a longitudinal aperture therethrough and said plurality of said blades affixed to an exterior surface of said sleeve, said longitudinal aperture of said sleeve further having a central longitudinal axis being parallel to and radially disposed from a geometric central axis of said sleeve thereby forming a counterbalance lobe substantially radially opposite a central axis of said aperture for balancing said sleeve assembly during rotation; said blades affixed to said exterior of said sleeve and positioned substantially opposite said counterbalance lobe.

21. A mixer as set forth in claim 20, wherein:

said sleeve assembly comprises a plurality of sleeve subassemblies, each said sleeve subassembly comprising an equal number of said blades affixed to said sleeve, said blades being longitudinally aligned, said sleeve subassembly being angularly disposed substantially equally about said shaft.

22. A mixer as set forth in claim 21, wherein:

said sleeve assembly comprises four sleeve subassemblies, said sleeve subassemblies being disposed about adjacent shafts in equal, opposite helical fashion, each of said sleeve subassemblies being angularly disposed substantially ninety degrees from the adjacent one of said sleeve subassemblies.

23. A mixer as set forth in claim 20, wherein:

said sleeve assembly comprises a plurality of sleeve subassemblies sleeved over said shaft, each said sleeve subassembly comprising one sleeve having a counterbalance lobe and one blade affixed to an exterior surface of said sleeve substantially opposite said counterbalance lobe.

24. A mixer as set forth in claim 23, wherein:

said sleeve subassemblies are angularly disposed substantially equally about said shaft, each blade of a transverse pair of sleeve subassemblies on adjacent of said mixer assemblies projecting predominately laterally in a predetermined same direction in one rotational position of said mixer assemblies when one blade of said transverse pair of sleeve assemblies is rotated by its shaft to project in said predetermined same direction.

25. A mixer as set forth in claim 24, wherein:

said sleeve subassemblies are arranged in sets, each said set comprising an equal number of sleeve subassemblies, said blades of each said set being longitudinally aligned, said sets of sleeve assemblies being angularly disposed substantially equally about the shaft.

26. A mixer as set forth in claim 25, wherein:

each said mixer assembly comprises four sets of sleeve subassemblies, said sets being disposed about said shafts in equal, opposite helical fashion, each of said sets of sleeve subassemblies being angularly disposed substantially ninety degrees from an adjacent one of said sets of sleeve subassemblies.

* * * * *